United States Patent [19]

Kasindorf

[11] 4,125,305

[45] Nov. 14, 1978

[54] READILY ACCESSIBLE AND LOCKABLE STORAGE AND PACKAGE SYSTEMS

[76] Inventor: Robert I. Kasindorf, Five Ashleigh Court, Glen Cove, N.Y. 11452

[21] Appl. No.: 708,966

[22] Filed: Jul. 26, 1976

[51] Int. Cl.[2] ..... A47B 81/00

[52] U.S. Cl. ..... 312/320; 312/223; 312/233

[58] Field of Search ..... 312/219, 319, 320, 333, 312/233, 223

[56] References Cited

U.S. PATENT DOCUMENTS

| | | | |
|---|---|---|---|
| 513,061 | 1/1894 | Slater | 312/333 X |
| 985,910 | 3/1911 | Lange | 312/333 X |
| 1,733,935 | 10/1929 | Blackstone | 312/320 X |
| 2,184,822 | 12/1939 | Unger | 312/233 |
| 2,547,486 | 4/1951 | Page | 312/333 X |
| 2,835,547 | 5/1958 | Erismann | 312/219 |
| 3,140,905 | 7/1964 | Trotter et al. | 312/320 |
| 3,567,303 | 3/1971 | Fox et al. | 312/320 |
| 4,002,381 | 1/1977 | Wagner et al. | 312/320 X |

*Primary Examiner*—Mervin Stein
*Assistant Examiner*—David H. Corbin
*Attorney, Agent, or Firm*—Nolte & Nolte

[57] ABSTRACT

An enclosed shelving system having a first planar member on which an item to be stored is disposed, said first planar member disposed generally parallel to a second planar member, at least one of said planar members having a trough therein in general facing relationship to the other planar member and the item to be stored, said item having a track therein in which is disposed a tongue, said tongue engaged within the said trough, said item having means for reciprocating and moving said tongue in said track to disengage it from said trough.

6 Claims, 11 Drawing Figures

READILY ACCESSIBLE AND LOCKABLE STORAGE AND PACKAGE SYSTEMS

BACKGROUND OF THE INVENTION

1. Field of the Invention

This invention relates to a shelving system. More especially, this invention relates to a shelving system of the partially enclosed type especially suitable for use in moving vehicles. More especially, this invention relates to shelving systems in which the items stored thereon are readily accessible but are secured to the shelving system. Still more especially, this invention relates to a shelving system in which there is securely stored, in a readily accessible manner, stowable data, products and appliances for use in mobile applications, such as boats, trailers, ambulances, aircrafts, and the like, and in stationary applications, such as computer facilities, offices, hospital emergency rooms, laboratories, homes, and the like, which system optionally can contain means for locking individual items or groups of items to be stored to the shelving system.

2. Discussion of the Prior Art

Partially open and partially enclosed shelving systems are, of course, well known. These generally comprise a six-sided assembly in which only one side is open. The sides are generally planar and items to be stored can rest on any of the planes, generally the longest plane. There are also known cabinets including means for securing the items to be stored to the cabinet. Generally, these cabinets involve a drawer which is on the nature of a filing cabinet through which can pass a simple slide bolt cooperating with a keeper in the cabinet frame. While such a device functions to maintain the items stored in place, no means are secured on each of the items for independent removal. Generally speaking, the simple slide bolt mechanism affects all of the items stored in the same manner. Thus, the items to be stored are not held by independent means to the storage assembly. Moreover, while file cabinets are useful to maintain items therein, there is an accessibility problem in that the drawer must be moved outwardly to allow access to the items therein or at least a cabinet door must be opened.

It has, therefore, become desirable to provide a storage system in the nature of a shelving system in which the items to be stored can be independently removed. More especially, it has become desirable to provide a shelving system which each of the individual items can be individually secured to the shelving system but can be individually removed therefrom. Still more especially, it has become desirable to provide such a shelving system in which locking means are provided to secure at least some of the items to be secured and prevent their unauthorized removal. Still more especially, it has become desirable to provide a shelving system useful in moving vehicles such as boats and aircraft wherein the items to be stored are readily accessible yet will not be removed upon a pitching of the vessel. The objects of this invention will be more readily apparent to one of skill in the art from the following disclosure.

SUMMARY OF THE INVENTION

Broadly, this invention contemplates an enclosed shelving system having a first planar member on which an item to be stored is disposed, said first planar member disposed generally parallel to a second planar member, at least one of said planar members having a trough therein in general facing relationship to the other planar member and the item stored therein, said item having a track therein in which is disposed a tongue, said tongue engaged within said trough, said item having means for reciprocatingly moving said tongue in said track to disengage it from said trough.

Particularly contemplated is a partially opened-partially enclosed shelving system in which there are provided first and second planar members in the manner of a normal shelf, interconnected by a back wall. In some embodiments, the first and second planar members or shelves can be also interconnected by a pair of opposed end walls thereby providing a shelving system having five side walls and leaving access on only one side thereof. Within one of the planar members in facing relationship to the other planar member and to an item stored therein, there is a trough. Preferably, the trough runs parallel to the open side of the system and in proximity thereto.

According to one embodiment of the invention, a plurality of troughs is provided, one on the first planar member in facing relationship to the other planar member and the item therein and the other on the second planar member also in facing relationship to the item stored therein and the opposed planar member. This permits the items to be stored therein to have a track and tongue mechanism either at its bottom or at its top. The mechanism on the item to be stored includes a means for reciprocatingly moving the tongue ridable in the track. This actuating means can include a lock mechanism so as to permit the item to be locked to the shelving system and be removable only upon a disengagement of the lock mechanism and commencement and termination of the reciprocating movement of the tongue.

In operation, a typical shelf contains a plurality of items to be stored. These items to be stored can themselves be storage containers such as containers for holding a ship's log or the like. Thus, the term "item" refers to some mechanism in the nature of a housing or the like which itself can be secured to the shelving system. Typically, a plurality of items is disposed in a single shelving system. One item will have a tongue movable in a track which is engaged in the trough of the upper planar member while another item will have an oppositely disposed securing system in which its tongue is also ridable in a track engaged in the trough of the other planar member. Each of these securing means on the items can include a lock mechanism. Generally, the actuating means for engaging the stored item to the shelf is disposed on an open or outside end of the item as it sits within the shelving system.

A particularly desirable embodiment of the present invention includes on the back wall of the shelving system an electrical connector in an electrical circuit. This electrical connector is, in turn, electrically engaged with a co-operation electrical connector within an item to be stored which is also in an electrical circuit. Preferably, the co-operating electrical connector of the item to be stored is housed within the body of the item and does not protrude outwardly. In this manner, the item to be stored functions as an electrical module. The item itself can be a ship's radio, a lamp or any other electrical apparatus. By such a mechanism, it is possible to install a citizen's band or marine radio in a ship to be powered off the ship's supply yet locked to the ship. This prevents the unauthorized removal of the radio while, at the same time, securing the same to the vessel so that it will not be displaced upon a pitching of the vessel. More especially, it permits the radio to be powered directly off a current supplied within the ship. Other connections for power antennas, signal transmission, etc. can be made through contact of the movable tongues in the track.

In another feature of the invention, means are provided to lock all or a portion of the items stored. This can be done by any of a variety of means. Generally speaking, locking means responsive to a single lock are disposed within the body of the shelving system which interconnect with the tongue mechanism when disposed within the troughs. In a simple form, the respective tongue mechanisms have a cut-out portion which is engaged by a movable protrusion actuated by an actuating mechanism including a lock therefor. Where all items to be stored are to be locked simultaneously, the respective tongue mechanisms will have a cut-out. Where it is desired that some items be removable while other remain locked to the shelving system, the tongue mechanisms for such removable items will have a cut out but in a different form, typically a step cut out. The protrusion member rests within the cut out. Removal of an item with a step cut out is insured owing to the absence of a portion of its body on either side of the protrusion. This will be more readily understood from the ensuing disclosure.

BRIEF DESCRIPTION OF DRAWINGS

In order to more fully appreciate the nature of the invention, reference is made to accompanying drawings in which.

DESCRIPTION OF SPECIFIC EMBODIMENTS

Figure 1:
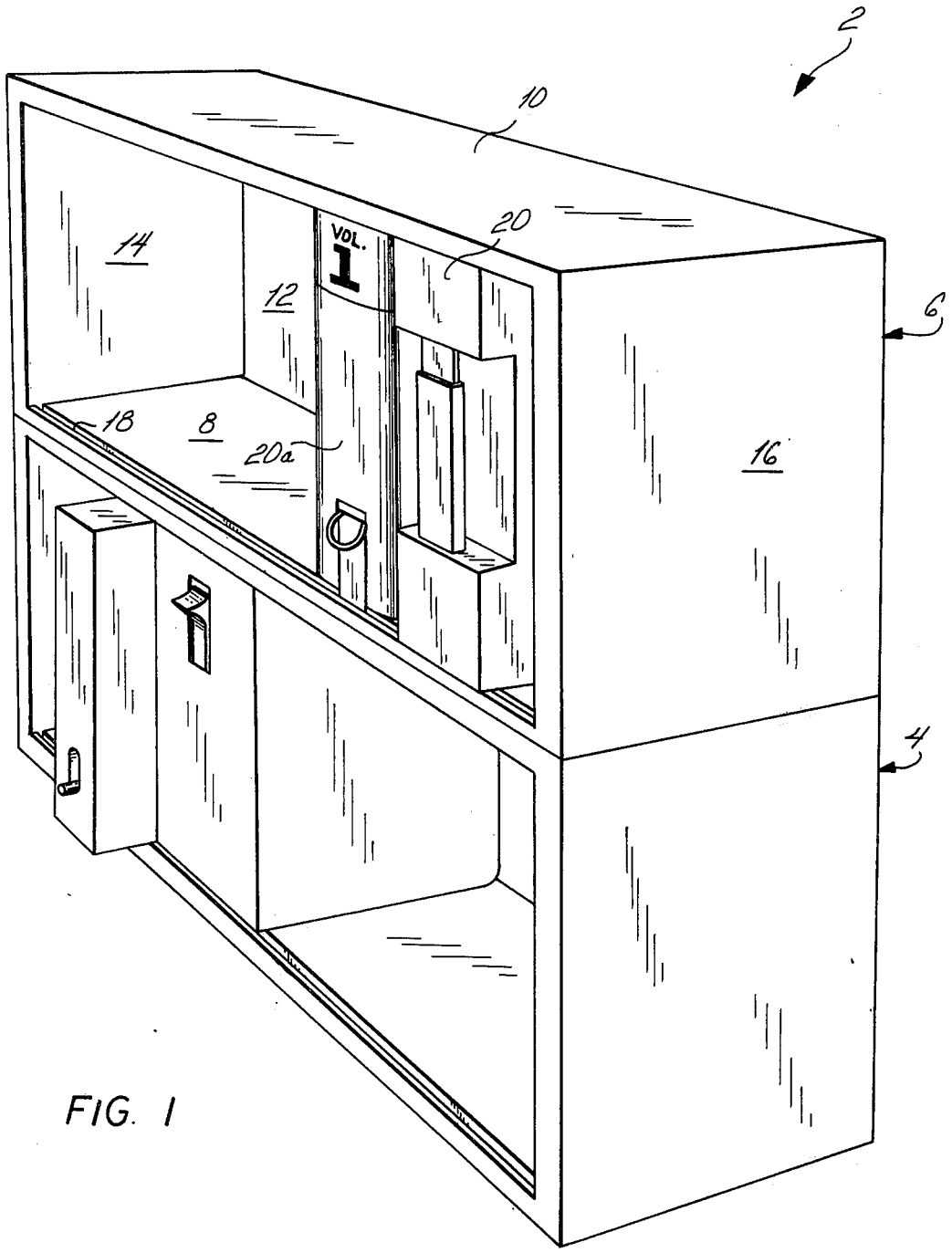
FIG. 1 is an isometric view of a shelving system of the invention, comprising a pair of shelves one disposed over the other.

Referring to FIG. 1, there is shown a shelving system 2 comprising the first shelving system 4 and a second shelving system 6 disposed thereover, each of which contains items to be stored. Generally speaking, and referring to shelving system 6, a shelving system of the invention comprises a first planar or bottom member 8 opposed to a generally parallel disposed top member 10 which are interconnected by a back wall 16. Planar member 8 and planar member 10 can be connected by end walls 14 and 12. Disposed parallel the open end (which faces wall 12) within one of the planar members 8 or 10, there is a trough 18 more readily visible in FIG. 2. Within the shelving system, a plurality of stored items 20 and 20*a* can be disposed.

Figure 2:
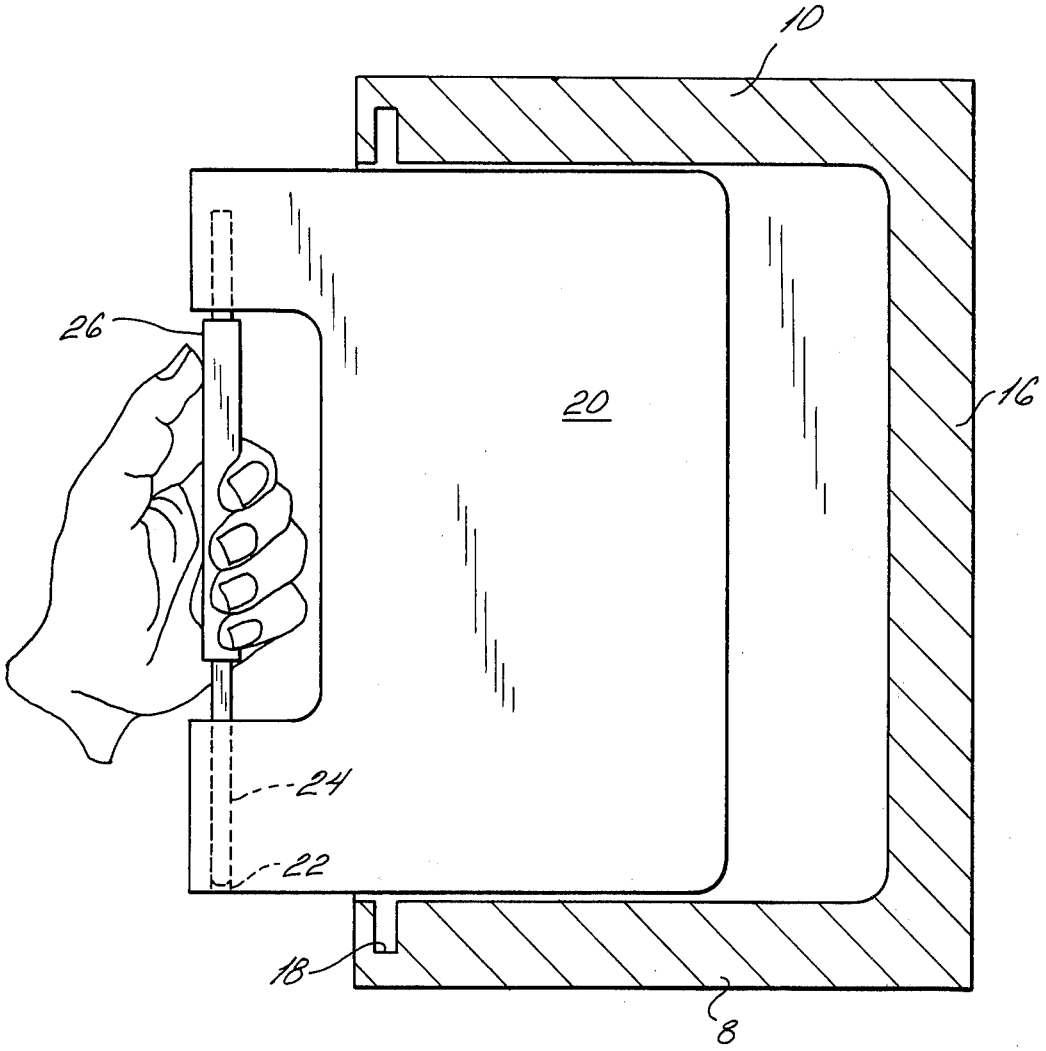
FIG. 2 is a side sectional view of a typical shelving system of the invention.
Figure 3:
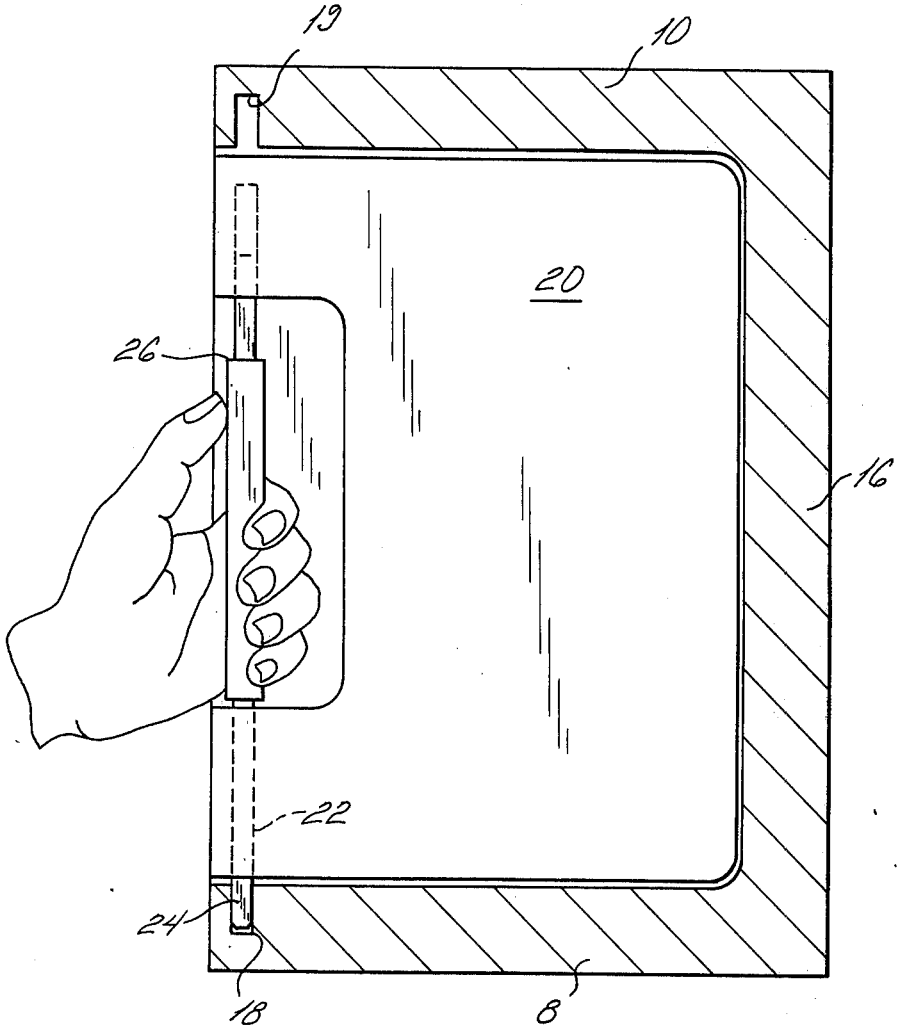
FIG. 3 is a view similar to FIG. 2 showing the engagement of an item to be stored within the shelving system.
Figure 4:
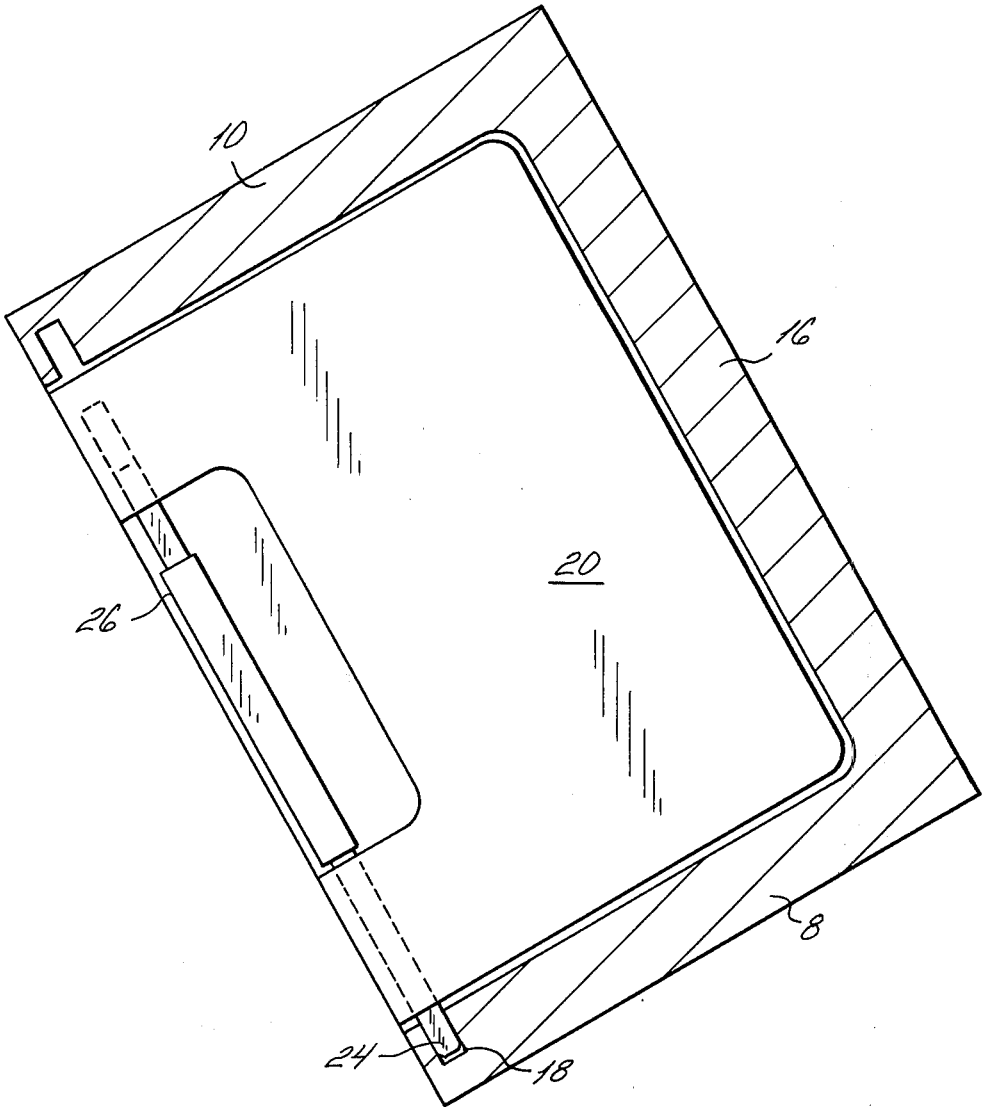
FIG. 4 is a view similar to FIGS. 2 and 3 showing how the item stored is secured to the shelving system upon pitch of the shelving system.

Referring to FIG. 2, a stored item 20 has disposed along a side thereof a track 22 within which sits a tongue 24 which is reciprocatingly movable therein. In operation, the item 20 is inserted within the shelving defined by walls 8,10 and 16 until the tongue 24 is in registry with the groove 18. As seen in FIG. 3, actuation of the reciprocating actuating means 26 allows the tongue to move within track 22 to dispose the same within trough 18. As noted in FIGS. 2 and 3, securement of item 20 to the shelving system need not be by engagement in a trough 18 on the lower planar member 8 but can be through engagement in an upper groove 19 of planar member 10 by a similar reciprocating movement. Additional securement can be at both the upper and lower troughs. When the item to be stored is disposed within the shelving system and the entire shelving system is pitched, the item to be stored remains secured to the shelving system as shown in FIG. 4. This makes the shelving system particularly useful on boats, ships, airplanes, trucks and the like.

Figure 5A:
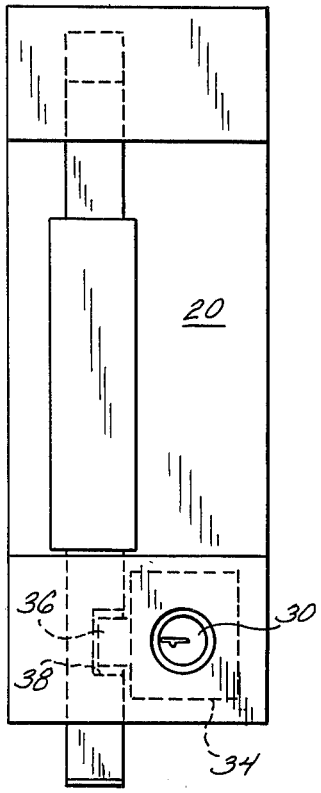
FIGS. 5 and 5*a* are front and side views of a lock mechanism on the stored item for locking the stored item to the shelving system.
Figure 5B:
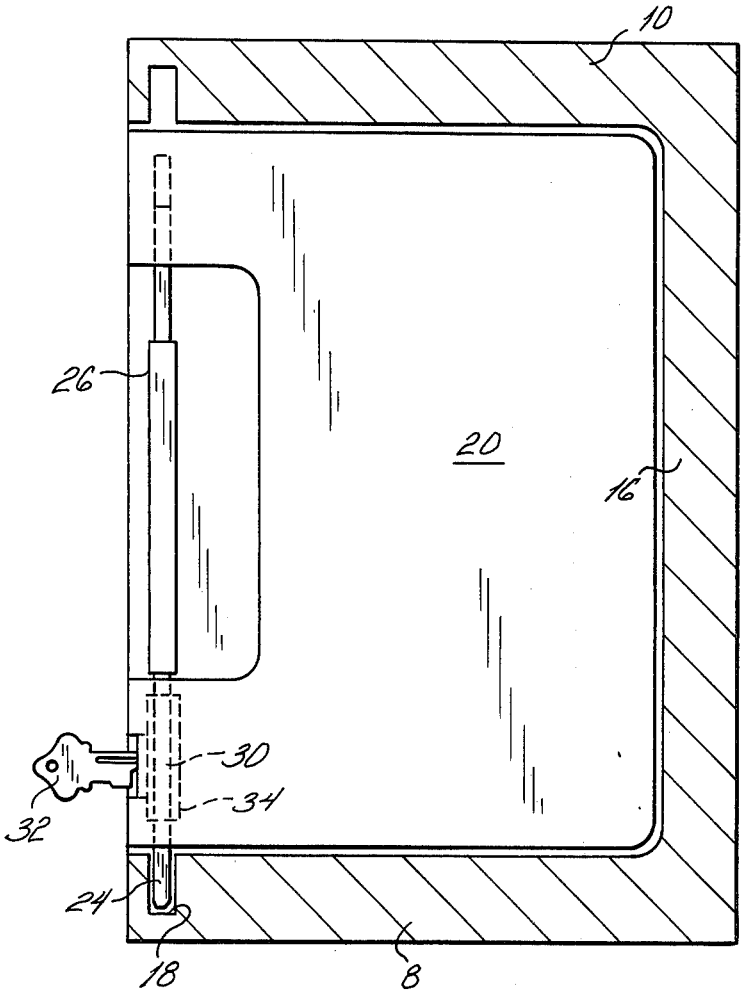

In FIG. 5 there is shown a particularly desired embodiment wherein means are provided on at least some of the items to be stored to lock the items to the shelf. To that end, there is provided a lock 30 engaged by a key 32 which lock 30 can sit within a lock housing 34. The key 32 when the item 20 is disposed within the shelving system itself will cause a lock tongue 36 to engage a tooth cut out 38 within a portion of said tongue disposed within the item itself. It is to be noted that this lock mechanism is entirely within the item itself and is distinct from a lock mechanism which would engage a portion of the tongue housed within the planar member 8, for example. In use, a shelving system can contain a number of items, some of which might be desired to be free from ready removal such as valuable ship's logs, radios, and the like. In such an event, the stored item includes the locking mechanism shown in FIG. 5. Removal of the remaining items is a simple matter while removal of the locked item requires a key or knowledge of a combination.

Figure 6:
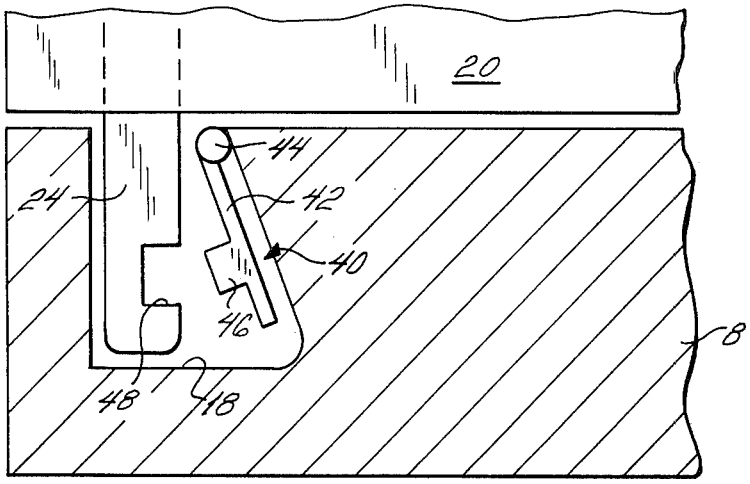
FIGS. 6 and 6*a* are partial side sectional views of the shelving system of the invention showing a mechanism common to a plurality of stored items for securing the same to the shelving system.
Figure 6A:
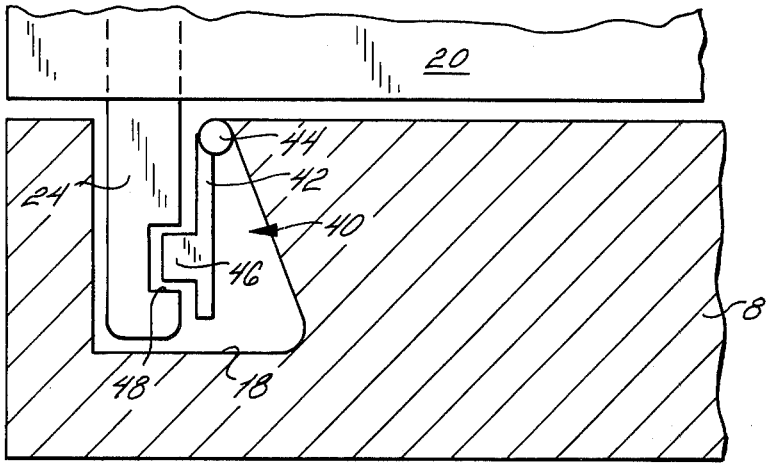
Figure 7:
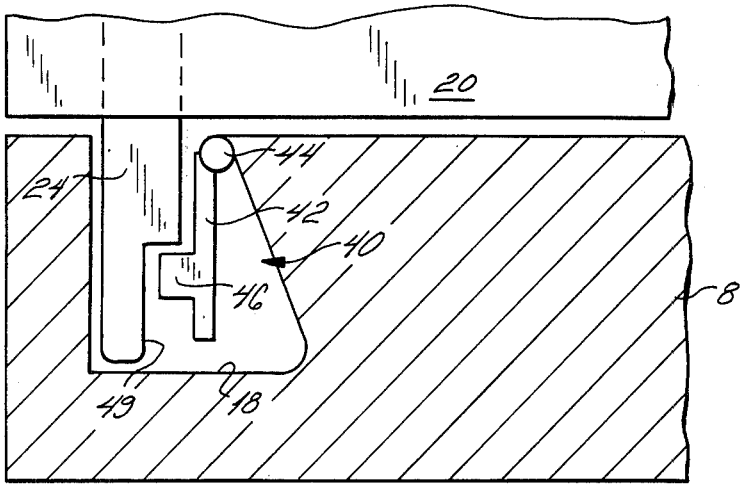
FIG. 7 is a view similar to FIGS. 6 and 6*a* showing a stepped cut out on the tongue portion of a stored item so that it can be removed notwithstanding locked engagement of other stored items in the same shelf.

Another locking system is illustrated in FIGS. 6, 6*a* and 7. In the embodiments of FIGS. 6, 6*a* and 7, a common locking means for all of the items to be stored is employed and the locking means engages a portion of the tongue while it is disposed within the trough. Referring to FIGS. 6 and 6*a*, there is employed a locking means 40 typically, but not necessarily, in the form of a pivotally mounted leg pivotal at pivot 44 having thereon a toothed protrusion 46. When the lock, which sits on the body of the shelving sytem itself, is engaged, the leg 42 pivots on pivot 44 to dispose the tooth protrusion 46 within a cut out 48 on a portion of the tongue of the item as it sits within the trough 18. This prevents reciprocating actuation of the tongue 24.

In such a shelving system, it may be desirable to permit a select few of the stored items to be removed notwithstanding lock securement of the remaining items. For such a purpose, the tongue of the item to be removed notwithstanding lock engagement of the remaining items has a stepped cut out 49 as illustrated in FIG. 7. It is to be understood that the locking mechanism 40 has a tooth protrusion which is common to all of the tongues of the stored items. Thus, there is but one lock which acts identically on all of the stored items. The mechanism of FIG. 7 is particularly useful for those items for which are to be removed in an emergency situation such as a fire extinguisher, first aid kit, emergency instructions, classified indexes and the like.

Figure 8:
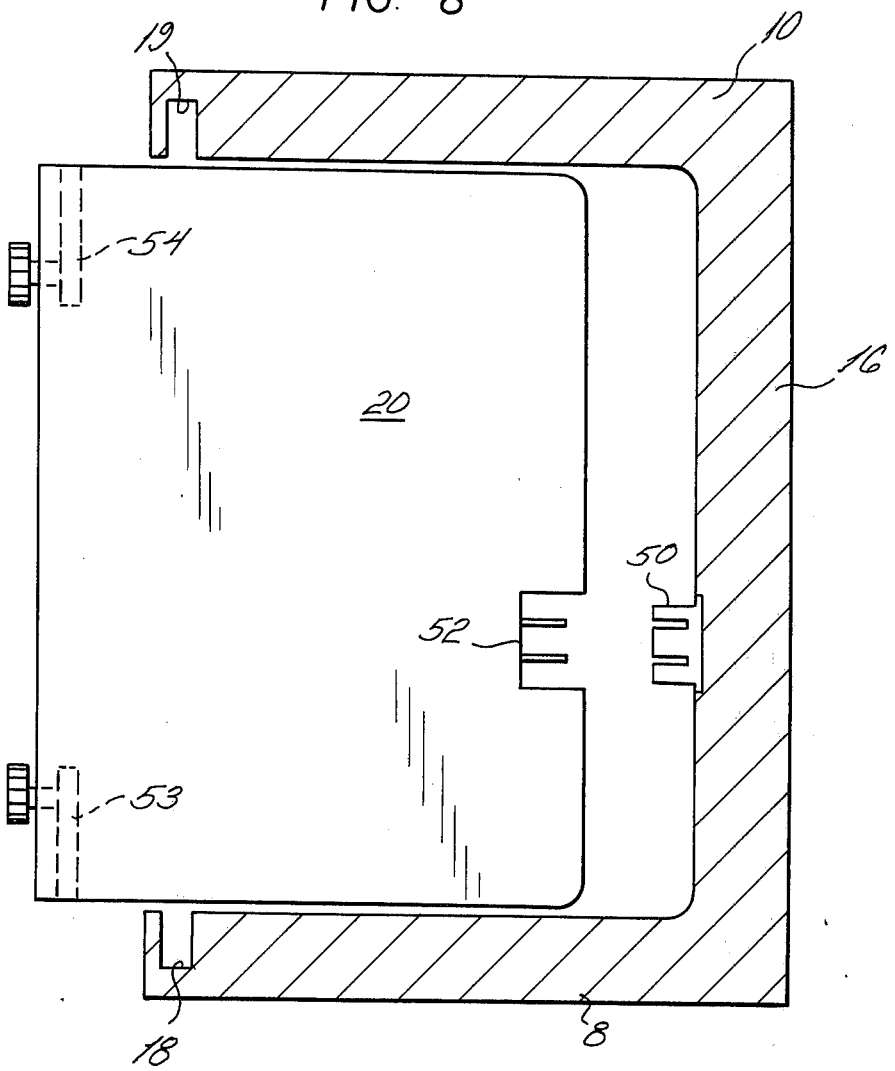
FIG. 8 is a sectional side view of an embodiment of the invention wherein electrical connecting means are disposed on the back wall of the shelf system for engagement with a reciprocating connector on the item to be stored, connections being made by contact of the movable tongue in the storage unit with the track in the shelf unit.
Figure 9:
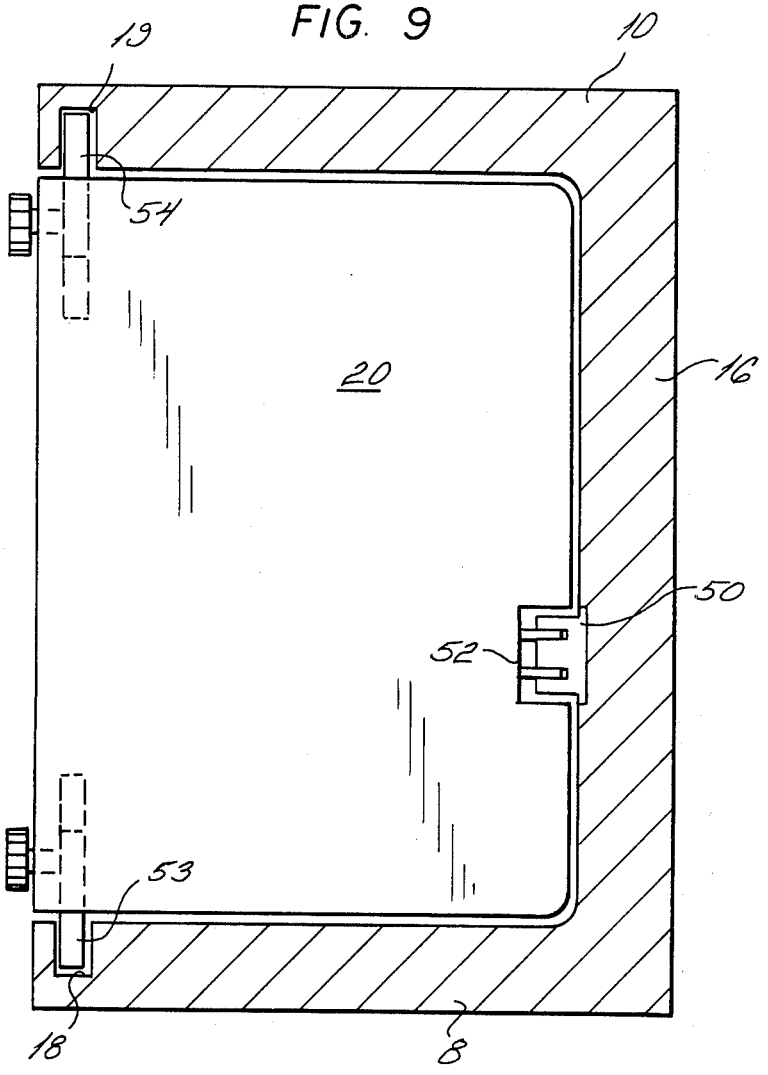
FIG. 9 is a view similar to FIG. 8 showing the connection of the stored item to the shelving system, including the electrical engagement of the respective electrical connectors.

FIGS. 8 and 9 show a particularly desired embodiment of the invention for use wherein the item to be stored includes components of an electrical circuit. Essentially, there is disposed on the back wall 16 an electrical connector 50 which is in facing relationship to a reciprocal electrical connector 52 housed in the item itself. Electrical connector 50 is in a first electrical circuit while electrical connector 52 is in a second electrical circuit. Obviously, when the stored item is disposed within the shelving system itself, the electrical circuits are connected. Generally speaking, such a system is employed to permit power to be transferred from a ship or other moving vehicle to the components of the stored item 20. This is particularly useful, as stated above, for ship's radios and the like. It is to be noted that the electrical connector 52 is housed within the body 20 of the item itself. It is also to be noted that the electrical connector 50 protrudes from the back wall. This system is provided so as to insure that other items not provided with electrical connectors are not inserted in that portion of the shelving system reserved for the item containing the electrical circuit. In such an instance, the back walls of such an item would abut against the protruding electrical connector 50 thereby prohibiting insertion of the item within the shelf. Also off center placement of the connector 50 would prevent inverted insertion of storage item 20.

FIG. 9 shows the manner by which the item is electrically connected to the connector 50. It is to be noticed that not only are the connectors 50 and 52 engaged within one another but that the usual tongue-in-trough engaging mechanism for the main portion of the item 20 to the shelving system is employed. FIGS. 8 and 9 also show the manner in which a plurality of actuating means on a single-stored item is employed in connection with facing troughs on the top and bottom planar members.

From the foregoing, it is apparent the invention supplies a shelving system wherein readily accessible securely held stowable data, products, appliances, and the like can be secured. It is apparent that the apparatus is particularly useful in mobile applications, such as boats, aircraft, ambulances and the like as well as in the stationary applications. The device can include a locking mechanism for individually locking stored items or can include a locking mechanism for locking entire groups of items in place so as to preclude their unauthorized removal or use. Further embodiment of the invention provides for the disposition of electronic equipment and maintains such devices in a state of electrical readiness. This provides means for monitoring and maintaining ancillary equipment, such as storage batteries, in addition to those built into electrical and electronic device modules, devices for reading engines and generator operating hours. It is also apparent that the mechanism on the stored items can include a latching device so thay can be independently locked to the shelving system, thereby rendering the same free from unauthorized removal. As an alternate or addition thereto, a simple locking mechanism for the plurality of devices can be provided which is simply housed within the shelving unit. Notwithstanding such a function, there is provided a mechanism which allows for the removal of select stored items, notwithstanding the engagement of a locking bar within the shelving system for the purpose of securing the plurality of stored items against unauthorized removal or use.

With respect to the modules of the invention which can be electrically operated in place which contain rechargeable batteries or which function with ancillary equipment, the latching mechanism of the invention also serves as a connector for one or more electrical contacts. In the case of devices requiring more than one type of service, additional plug or attachment arrangements can be provided such as an AC-operated battery charger to serve as the DC system prevailing on a moving vehicle, connections to antennae systems and the like. It should be apparent that a wide variety of departures from the above specific disclosure are possible. For instance, instead of employed a single lock locking mechanism operating with an actuating means on an item itself as shown in FIG. 5, a plurality of such locking mechanism can be employed. Such would normally be employed in connection with the plurality of actuating means. In such a device, there is a first tongue which engages in a first groove of a lower planar member 8 and a second tongue operable in response to a second actuating means which engages a trough of the upper planar member. Each of these respective tongue members are provided with tooth cut outs which can be engaged by separate lock mechanisms thereby providing additional security against removal of such items from the shelf. Such are useful in the storage of highly classified material, dangerous drugs, chemicals, and the like.

The stored items of the invention can readily be removed from the shelving system and transported. Locking devices on such items provide for security when the storage module is in transit from the shelf unit to another location. Modules can contain warning devices wherein a signal is transmitted in the event of fire, smoke, tampering, water seepage and the like.

It is to be understood that the shelving system of the present invention can be disposed on its end whereby the trough will, in effect, be vertically disposed. In such an event, shelving can be inserted within the vertically disposed shelving unit so that the same can function more or less as a vertically disposed storage cabinet. These inserted shelves act as dividers, thereby allowing the shelving system of the invention to be used horizontally or vertically.

It is to be understood that the present invention permits the storing of a wide variety of items. It is further to be understood that the present invention particularly is useful in securing the stored items in the shelving system and restraining them from capsizing outwardly in the event the shelving system itself should be pitched as could occur in moving vehicles, such as boats and the like. The storage system of the present invention could be useful in the storing of items such as food stuffs, toilet kits, repair kits, dehumidifiers, liquor, food, insulated bottles, books, lamps, stoves and fuel containers, emergency rations, game sets, cameras, trash receptacles, facial tissue, radio and electronic equipment, first aid materials, instruction cards, battery packs, spare bulbs, fuses, modular galley units, e.g., refrigerator units, engine hour meters, battery condition indicators, burglar alarms, fire and smoke alarms, flashlights, lamps, writing kits, log books, strong boxes, sextants, hand bearing compass, chronometers, charts, range finders, binoculars, dye markers, shark repellent, inflatables repair kits, radar reflector, spare parts kit, tool and wrench kits, stereo receivers, speakers, electrical test kits, battery charger, electrical fans, and heater and fire extinguisher, to name a few.

The apparatus is used in buses, trains, aircrafts, boats, and other conveyances, as well as in check rooms and locker areas of such places as transit terminals and on luggage and parcel handling equipment. The system prevents the falling of luggage and parcels in the event of tilting of the conveyance, provides means for locking luggage and parcels in place, preventing accidental or unauthorized removal.

The terms and expressions used herein are to be used as terms and expressions of illustration and not of limitation so there is no intention in the use of such terms and expressions of excluding any equivalents or portions thereof, as various modifications and departures therefrom will become apparent to one of skill in the art from the previous disclosure.

What is claimed is:

1. A storage system comprising, in combination, a box-like compartment having top and bottom walls, opposite side wall means and an open front and a plurality of items receivable in said compartment and disposable on said bottom wall in side by side relationship to be removable individually and independently through said open front and to be movable along said bottom wall in the direction from one side wall to another and across said bottom wall transversely to said direction, a groove extending longitudinally along the entire length of the interior surface of at least one of said top and bottom walls and extending across the same between said side walls, at least one of said items comprising a body and a bolt element movable relative to that body and into and from said groove, said at least one of said items having a height only slightly less than the spacing between said top and bottom walls whereby said bolt element, when projected into said groove, constitutes means to prevent inadvertent removal of said item from said compartment.

2. A shelving system according to claim 1 wherein a back wall of said compartment has an electrical connector in an electrical circuit which connector is releasably engaged with an electrical connector of an item disposed on said shelf.

3. A system according to claim 1 wherein there are provided divider means at spaced intervals along said compartment.

4. A storage system as claimed in claim 1 comprising a locking element disposed adjacent to and extending longitudinally of said groove and shiftable between a first, operative position in which it projects into said groove to capture a cooperating bolt member of anyone of a plurality of items disposed on said shelf and a second, inoperative position displaced from said groove to free such bolt members, and a lock effective to maintain said locking element in said first position.

5. A system as claimed in claim 4 wherein at least two of said bolt members of said items have a keeper configuration formed thereon and said locking element has a cooperating latch structure extending along the full length of said bolt element said slip structure being engagable in each of said keeper configurations of said items.

6. A system as claimed in claim 5 wherein said locking member is mounted for pivotal movement between said first and second positions about an axis extending longitudinally of said groove.

* * * * *